US008523347B2

(12) United States Patent
Satoh

(10) Patent No.: US 8,523,347 B2
(45) Date of Patent: Sep. 3, 2013

(54) SHEET CONVEYANCE DEVICE AND IMAGE FORMING APPARATUS

(75) Inventor: Tadashi Satoh, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 181 days.

(21) Appl. No.: 12/929,583

(22) Filed: Feb. 2, 2011

(65) Prior Publication Data

US 2011/0205323 A1 Aug. 25, 2011

(30) Foreign Application Priority Data

Feb. 25, 2010 (JP) ..... 2010-040101

(51) Int. Cl.
*B41J 2/01* (2006.01)
*B41J 29/13* (2006.01)

(52) U.S. Cl.
USPC ..... 347/104; 347/101; 347/108

(58) Field of Classification Search
None
See application file for complete search history.

(56) References Cited

U.S. PATENT DOCUMENTS

| | | | | |
|---|---|---|---|---|
| 5,881,352 | A * | 3/1999 | Kobayashi et al. | 399/408 |
| 6,102,393 | A * | 8/2000 | Kida et al. | 271/303 |
| 6,171,225 | B1 * | 1/2001 | Nonoyama et al. | 493/16 |
| 6,351,625 | B1 * | 2/2002 | Sato et al. | 399/382 |
| 6,398,212 | B1 * | 6/2002 | Miyake | 271/186 |
| 6,719,680 | B2 * | 4/2004 | Hosoya et al. | 493/324 |
| 6,733,007 | B2 * | 5/2004 | Sekiyama et al. | 271/65 |
| 6,895,212 | B2 * | 5/2005 | Yamakawa et al. | 399/407 |
| 7,549,723 | B2 | 6/2009 | Mihara et al. | |
| 7,881,652 | B2 * | 2/2011 | Edwards et al. | 399/364 |
| 8,414,206 | B2 * | 4/2013 | Asada | 400/188 |
| 2003/0230845 | A1 * | 12/2003 | Fujii et al. | 271/176 |
| 2006/0214364 | A1 * | 9/2006 | Clark et al. | 271/228 |
| 2007/0045947 | A1 * | 3/2007 | Fujii et al. | 271/279 |
| 2007/0200888 | A1 * | 8/2007 | Inoue et al. | 347/16 |
| 2008/0150227 | A1 * | 6/2008 | Hirokawa et al. | 271/265.01 |
| 2008/0165242 | A1 * | 7/2008 | Hiroki et al. | 347/104 |
| 2008/0239053 | A1 * | 10/2008 | Sakano | 347/104 |
| 2009/0087237 | A1 | 4/2009 | Sato | |
| 2009/0237477 | A1 * | 9/2009 | Kumagai | 347/101 |
| 2010/0072693 | A1 * | 3/2010 | Ishikawa et al. | 271/227 |
| 2010/0296856 | A1 * | 11/2010 | Moriyama | 400/642 |

FOREIGN PATENT DOCUMENTS

| | | | |
|---|---|---|---|
| JP | 2004155553 | A | 6/2004 |
| JP | 2006213480 | A | 8/2006 |
| JP | 2009040550 | A | 2/2009 |
| JP | 2009086506 | A | 4/2009 |

* cited by examiner

*Primary Examiner* — Stephen Meier
*Assistant Examiner* — Leonard S Liang
(74) *Attorney, Agent, or Firm* — Harness, Dickey & Pierce

(57) ABSTRACT

Disclosed is a sheet conveyance device installed in an image forming apparatus having an image forming part that forms an image on a sheet member. The sheet conveyance device includes an ejecting/inverting path functioning not only as an ejecting path through which the sheet member having the image formed thereon by the image forming section is ejected outside the image forming apparatus but also as an inverting path through which the sheet member having the image formed thereon is conveyed with front and rear sides thereof inverted in a direction opposite to an ejecting direction; and an inverted-sheet directly ejecting path through which the sheet member with the front and rear sides thereof inverted in the ejecting/inverting path is ejected outside the image forming apparatus without passing through the image forming part.

15 Claims, 8 Drawing Sheets

SHEET CONVEYANCE DEVICE AND IMAGE FORMING APPARATUS

BACKGROUND OF THE INVENTION

1. Field of the Invention

The present invention relates to a sheet conveyance device installed in an image forming apparatus like a copier, a printer, a facsimile machine, or a multifunction peripheral having plural such functions, and the image forming apparatus having the sheet conveyance device.

2. Description of the Related Art

A known image forming apparatus like a copier, a printer, a facsimile machine, or a multifunction peripheral having plural such functions has an inverting conveyance path, through which sheets having images formed thereon are conveyed with their front and rear sides inverted, so as to perform double-sided printing or collate the sheets.

In an image forming apparatus described in Patent Document 1, the front and rear sides of sheets are inverted in a supplying path, through which the sheets are conveyed from a sheet feeding cassette to an image forming part, so as to form images on both sides of the sheets. That is, the supplying path acts also as an inverting conveyance path. In conveying the sheets having images formed thereon with their front and rear sides inverted so as to collate the sheets, the sheets are first fed to a double-sided conveyance path (first conveyance path) provided right before the inverting conveyance path and then inverted. Thus, the sheets are capable of being directly ejected without being guided to the image forming part again.

Further, an image forming apparatus described in Patent Document 2 has plural inverting conveyance paths on the upstream side of an image forming part in a sheet conveyance direction.

Further, an image forming apparatus described in Patent Document 3 has a dedicated inverting conveyance path to guide sheets the front and rear sides of which are inverted to an image forming part.

Further, an image forming apparatus described in Patent Document 4 has a dedicated inverting conveyance path other than a double-sided conveyance path, and is configured to be capable of ejecting sheets the front and rear sides of which are inverted in the double-sided conveyance path or the inverting conveyance path without guiding them to an image forming part again.

Next, a discussion is made of an operation (i.e., inversion and ejection) in which sheets having images formed only on one of their surfaces are collated and ejected.

First, in the image forming apparatuses described in Patent Documents 2 and 3, sheets the front and rear sides of which are inverted are conveyed to the image forming part again. Accordingly, even when the sheets having images formed only on one of their surfaces are collated and ejected, the sheets must pass through the image forming part. Therefore, the image forming apparatuses have disadvantages in that the paths required to eject the sheets become long and productivity (first copy time and PPM (Pages Per Minute)) is decreased. Further, as the conveyance paths become long, there is a high likelihood of causing jamming. Moreover, conveyance rollers, guide plates, and the like provided on the upstream sides of the image forming parts are brought into contact with the image forming surfaces of the sheets. Therefore, the image forming apparatuses have another disadvantage in that the conveyance rollers, the guide plates, and the like are likely to be stained by toner and images are easily degraded.

In the image forming apparatus described in Patent Document 1, the sheets having images formed only on one of their surfaces are temporarily fed to the path, which acts not only as the conveyance path through which the sheets are returned to the image forming part again so as to perform double-sided printing but also as the supplying path through which the sheets from the sheet feeding cassette are supplied, and are then directly ejected with their front and rear sides inverted. Accordingly, the image forming apparatus described in Patent Document 1 does not have a dedicated inverting conveyance path like those provided in the image forming apparatuses described in Patent Documents 2 and 3.

However, in order to invert and eject the sheets having images formed thereon with the image forming apparatus described in Patent Document 1, conveyance-path switching units (switching claws) must be provided at two branching parts (i.e., a branching part at which a third conveyance path 24 branches off a second conveyance path 23 and a branching part at which a fourth conveyance path 25 branches off the third conveyance path 24 shown in FIG. 1 of Patent Document 1). For this reason, an actuator (e.g., a solenoid or a motor) that drives the two switching units is also required. Further, the sheets having images formed only on one of their surfaces are temporarily fed to the path, which acts also as the supplying path through which the sheets are supplied from the sheet feeding cassette, so as to be collated and ejected. Therefore, the image forming apparatus has a disadvantage in that conveyance rollers, a guide plate, and the like provided to feed the sheets from the sheet feeding cassette are brought into contact with the image forming surfaces of the sheets and likely to be stained.

The image forming apparatus described in Patent Document 4 is configured to be capable of ejecting the sheets the front and rear sides of which are inverted without guiding them to the image forming part again. Therefore, compared with the image forming apparatuses described in Patent Documents 2 and 3, the image forming apparatus can reduce the entire length of the conveyance paths and thus improve its productivity. Further, in collating and ejecting the sheets to which single-sided printing is applied, the image forming apparatus is free from a problem in which conveyance rollers, a guide plate, and the like provided on the upstream side of the image forming part are stained compared with the image forming apparatuses described in Patent Documents 1 through 3.

However, the image forming apparatus described in Patent Document 4 has the dedicated inverting conveyance path other than the inverting conveyance path acting also as the double-sided conveyance path. Therefore, it is necessary to secure space for the dedicated inverting conveyance path and separately provide conveyance rollers, a guide plate, and the like. This runs contrary to recent demand for downsizing image forming apparatuses and cost reduction.

Further, the image forming apparatuses described in Patent Documents 3 and 4 convey sheets through a switch back path only with inverting conveyance rollers. Therefore, when, e.g., long and thin sheets enter in a conveyance direction, the sheets are not properly guided to the switch back path and are buckled and damaged along the way of the path. Further, when the lengths of upper and lower conveyance guide plates, which restrict the length of the sheets in the conveyance direction accommodated in the switch back path, are insufficient, the tip end surfaces of the sheets act violently to get stuck on other members at the time of entering the switch back path, so that conveyance problems such as skewing and jamming are sometimes caused. In order to prevent this phenomenon, it is necessary to provide plural rollers along the way of the switch back path and secure sufficient lengths of the conveyance guide plates, which results in an increase in the number of components and cost. Further, even if the inverting conveyance path acting also as the double-sided conveyance path is used to invert the sheets, conveyance-path switching units (switching claws) must be provided at two parts like the image forming apparatus described in Patent Document 1 and thus an actuator (e.g., a solenoid or a motor) that drives the two parts must be required.

Further, in the image forming apparatus described in Patent Document 4, the image forming surfaces of the sheets are directed downward in the double-sided conveyance path so as to perform the switching back of the sheets on the double-sided conveyance path, while they are directed upward in the double-sided conveyance path so as to make the sheets enter the double-sided conveyance path via the dedicated inverting conveyance path. That is, the image forming surfaces are directed upward or downward in the double-sided conveyance path as required. Meanwhile, in the case of using, e.g., an ink jet method as an image forming method, rollers (point-contact rollers) having a small contact area with the image forming surfaces are employed as the conveyance rollers provided in the double-sided conveyance path so as not to influence undried image forming surfaces when the sheets enter the double-sided conveyance path with ink on the image forming surfaces being undried. However, when the image forming surfaces are directed upward and downward in the double-sided conveyance path as in the image forming apparatus described in Patent Document 4, the rollers (point-contact rollers) having a small contact area are required as the conveyance rollers on both of the upper and lower sides of the double-sided conveyance path. Therefore, this runs contrary to demand for cost reduction.

Patent Document 1: JP-A-2004-155553
Patent Document 2: JP-A-2006-213480
Patent Document 3: JP-A-2009-86506
Patent Document 4: JP-A-2009-40550

SUMMARY OF THE INVENTION

In light of the above circumstances, the present invention may provide a sheet conveyance device capable of ejecting sheet members the front and rear sides of which are inverted outside an apparatus without passing through an image forming part and capable of realizing downsizing and cost reduction. The present invention may also provide the image forming apparatus having the sheet conveyance device.

According to an embodiment of the present invention, there is provided a sheet conveyance device installed in an image forming apparatus having an image forming part that forms an image on a sheet member. The sheet conveyance device includes an ejecting/inverting path functioning not only as an ejecting path through which the sheet member having the image formed thereon by the image forming section is ejected outside the image forming apparatus but also as an inverting path through which the sheet member having the image formed thereon is conveyed with front and rear sides thereof inverted in a direction opposite to an ejecting direction; and an inverted-sheet directly ejecting path through which the sheet member with the front and rear sides thereof inverted in the ejecting/inverting path is ejected outside the image forming apparatus without passing through the image forming part.

Other objects, features and advantages of the present invention will become more apparent from the following detailed description when read in conjunction with the accompanying drawings.

DETAILED DESCRIPTION OF THE PREFERRED EMBODIMENTS

Figure 1:
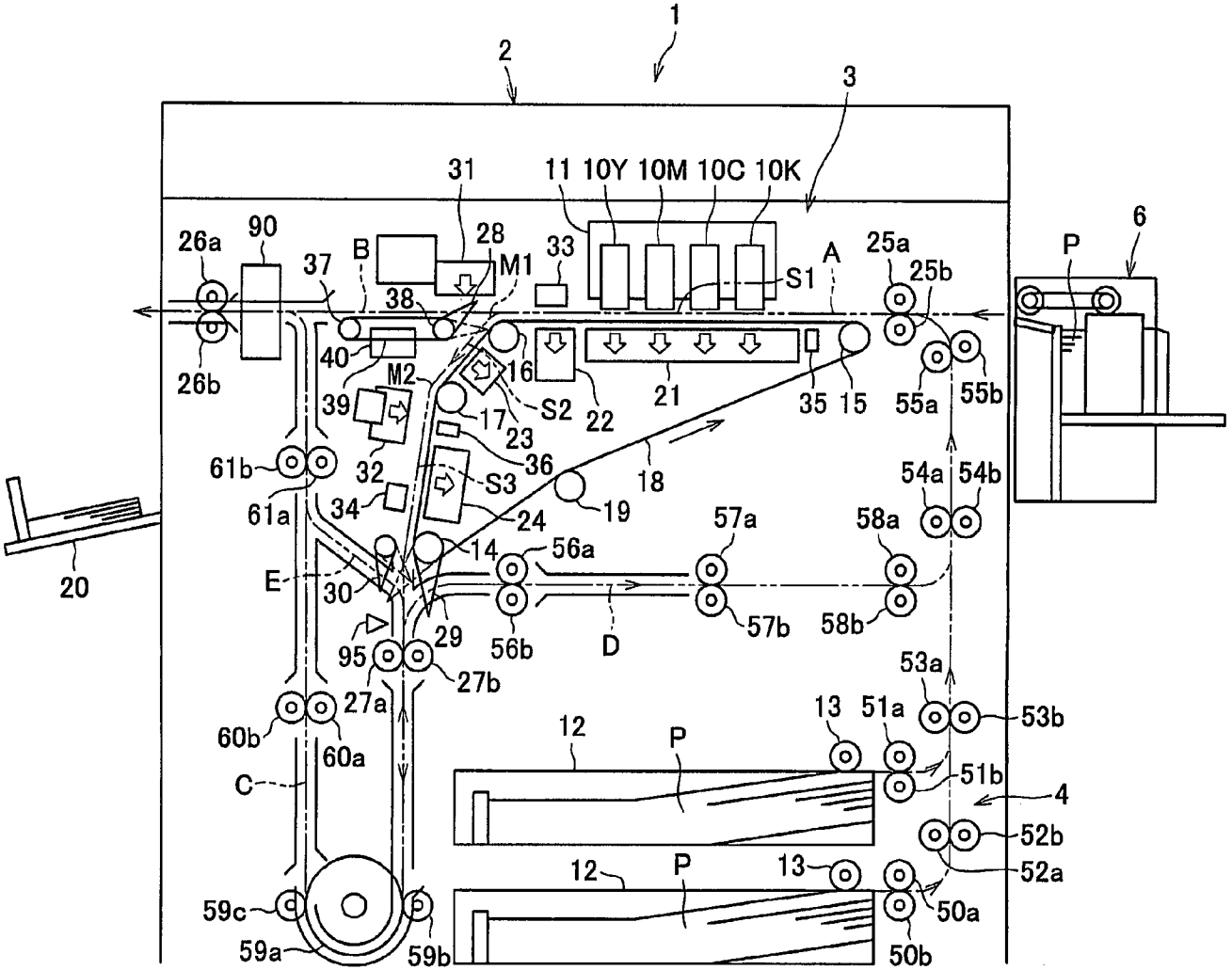
FIG. 1 is a view showing the schematic configuration of an ink jet printer in which a sheet conveyance device according to embodiments of the present invention is installed.

Next, a description is made of embodiments of the present invention with reference to the accompanying drawings. Note that in the drawings, the same or equivalent parts are denoted by the same reference symbols and their duplicated descriptions are simplified or omitted as occasion demands.

With reference to FIG. 1, a description is first made of the entire configuration of an image forming apparatus in which a sheet conveyance device according to the embodiments of the present invention is installed.

In FIG. 1, reference symbol 1 denotes the apparatus main body of an ink jet printer acting as the image forming apparatus according to the embodiments of the present invention. In the apparatus main body 1, an image scanning part 2, an image forming part 3, a sheet feeding part 4, and the like are provided.

The image scanning part 2 is configured to feed documents placed on a document stage to a scanning position at which a contact image sensor (not shown) is provided and eject the documents to a document ejecting tray (not shown) after image scanning by the contact image sensor. The image forming part 3 has an image forming head unit 11 including line type ink jet heads 10K, 10C, 10M, and 10Y of four colors of black, cyan, magenta, and yellow. In the sheet feeding part 4, plural sheet feeding cassettes 12 accommodating sheets P acting as sheet members are provided. Each of the sheet feeding cassettes 12 is provided with a feeding roller 13 that feeds the accommodated sheets P. Further, on the downstream sides of the feeding rollers 13 in a sheet conveying direction, pairs of feed reverse rollers 50*a*, 50*b*, 51*a*, and 51*b* that separate the sheets P one by one are provided. Further, in the embodiments of the present invention, a sheet feeding unit 6 acting as another sheet feeding part is provided on the right side of the apparatus main body 1 in FIG. 1. The sheets supplied from the sheet feeding unit 6 or the sheet feeding cassettes 12 are subjected to image formation by the image forming part 3 and finally ejected to a sheet ejecting tray 20 provided on the left side of the apparatus main body 1 in FIG.

1. Further, an aftertreatment unit (finisher), which applies so-called aftertreatment such as stapling, folding, punching, and book binding to the sheets after image formation, may be provided.

In FIG. 1, chain double-dashed lines indicate conveyance paths through which the sheets are conveyed. Further, the directions of arrows added to the chain double-dashed lines indicate the conveyance directions of the sheets. In the embodiments of the present invention, the conveyance paths are composed of first through fifth conveyance paths A through E.

The first conveyance path A is a conveyance path through which the sheets supplied from the sheet feeding cassettes 12 or the sheet feeding unit 6 are guided to the image forming part 3. Specifically, the first conveyance path A includes horizontal and vertical conveyance paths that guide the sheets fed from the sheet feeding cassettes 12 to the image forming part 3 and a horizontal conveyance path that guides the sheets fed from the sheet feeding unit 6 to the image forming part 3, and is configured to join these conveyance paths together along its way. Further, in the first conveyance path A, a pair of resist rollers 25*a* and 25*b* that correct skewing of the sheets and adjust conveyance timing of the sheets are provided on the upstream side of the joining position of the conveyance paths in the conveyance direction.

The second conveyance path B is a conveyance path through which the sheets after image formation are ejected outside the apparatus, and is provided so as to be straight in a horizontal direction along the first conveyance path A. On the downstream side of the second conveyance path B in the conveyance direction, a pair of ejecting rollers 26*a* and 26*b* that eject the sheets outside the apparatus are provided. Further, on the upstream side of the pair of ejecting rollers 26*a* and 26*b* in the conveyance direction, a decurling part 90 that decurls the sheets is provided. As the decurling part 90, known techniques such as arranging three rollers opposite to each other so as to form a curved path between them and bringing a hard roller into contact with a soft roller so as to form a curved path at a contact part between them are applicable for correcting the curling of the sheets.

The third conveyance path C extends downward from the downstream side of the first conveyance path A in the conveyance direction, turns around upward at the lower part of the apparatus main body 1, and joins the second conveyance path B on the upstream side of the decurling part 90. Further, on the upstream side of the third conveyance path C in the conveyance direction and at a position at which the third conveyance path C branches off the second conveyance path B, a switching claw 28 acting as a conveyance path switching unit that selects one of the second conveyance path B and the third conveyance path C and guides the sheets is provided. Further, along the way of the third conveyance path C, a pair of inverting conveyance rollers 27*a* and 27*b* capable of normally and reversely rotating are provided. When the pair of inverting conveyance rollers 27*a* and 27*b* normally rotate, the sheets are conveyed downward in a sheet ejecting direction in FIG. 1. On the other hand, when the pair of inverting conveyance rollers 27*a* and 27*b* reversely rotate, the sheets are conveyed (upward in FIG. 1) in a direction opposite to the sheet ejecting direction. Further, on the upstream side of the pair of inverting conveyance rollers in the conveyance direction (the ejecting direction) when the pair of inverting conveyance rollers 27*a* and 27*b* normally rotate, a detecting sensor 95 that detects the rear ends of the sheets is provided.

The fourth conveyance path D is provided so as to branch off the third conveyance path C on the upstream side of the pair of inverting conveyance rollers 27*a* and 27*b* in the conveyance direction (the ejecting direction) at the normal rotation of the pair of inverting conveyance rollers 27*a* and 27*b* and join the first conveyance path A. At a position at which the fourth conveyance path D branches off the third conveyance path C, a switching claw 29 acting as a conveyance path switching unit that guides the sheets reversely fed from the third conveyance path C to the fourth conveyance path D is provided.

The fifth conveyance path E is provided so as to branch off the third conveyance path C on the upstream side of the pair of inverting conveyance rollers 27*a* and 27*b* in the conveyance direction (the ejecting direction) at the normal rotation of the pair of inverting conveyance rollers 27*a* and 27*b* and join the third conveyance path C on the downstream side of the third conveyance path C. Further, at a position at which the fifth conveyance path E branches off the third conveyance path C, a switching claw 30 acting as a conveyance path switching unit that guides the sheets reversely fed from the third conveyance path C to the fifth conveyance path E is provided.

Further, in the apparatus main body 1, a sheet conveyance device having various conveyance units that convey the sheets along the above conveyance paths is installed. The sheet conveyance device has a conveyance belt 18 provided below the image forming part 3 as one of the conveyance units. The conveyance belt 18 is formed of an endless belt and bridged by a driving roller 14 and three driven rollers 15, 16, and 17. Further, a predetermined tensile force is applied to the conveyance belt 18 by a tension roller 19. The driving roller 14 is capable of being driven to rotate by a driving unit (not shown). As the driving roller 14 rotates, the conveyance belt 18 is rotated in a direction as indicated by an arrow in FIG. 1. Further, on the downstream sides of the driven rollers 15 and 17 in the sheet conveyance direction, sheet detecting sensors 35 and 36 that detect the sheets are provided, respectively.

Here, a conveyance surface (conveyance path) that carries and conveys the sheets on the conveyance belt 18 is composed of a horizontally-provided first straight conveyance part S1; an arc-shaped first folded conveyance part M1 consecutively provided on the downstream side of the first straight conveyance part S1 in the conveyance direction; a second straight conveyance part S2 obliquely and consecutively provided on the downstream side of the first folded conveyance part M1 in the conveyance direction; an arc-shaped second folded conveyance part M2 consecutively provided on the downstream side of the second straight conveyance part S2 in the conveyance direction; and a third straight conveyance part S3 obliquely and consecutively provided on the downstream side of the second folded conveyance part M2 in the conveyance direction.

Further, the sheet conveyance device has an air attracting unit that suctions air on the side of the rear surface of the conveyance belt 18 so as to attract the sheets onto the conveyance belt 18. The air attracting unit has first through fourth suction ducts 21 through 24 acting as air introducing paths provided on the side of the rear surface of the conveyance belt 18 and a suction fan (not shown) acting as an air suction unit that separately suctions air from the respective suction ducts 21 through 24. In the conveyance belt 18, a multiplicity of small holes from which air is suctioned are formed. The air attracting unit is structured to suction air from the small holes through the respective suction ducts 21, 22, 23, and 24 so as to attract the sheets onto the conveyance belt 18.

The positions of the respective suction ducts 21 through 24 are specifically described. The first suction duct 21 is provided below the image forming part 3 so as to oppose the first straight conveyance part S1. The second suction duct 22 is provided near the upstream side of the first folded conveyance part M1 in the sheet conveyance direction so as to oppose the first straight conveyance part S1. The third suction duct 23 is provided at a position opposing the second straight conveyance part S2. Further, the fourth suction duct 24 is provided at a position opposing the third straight conveyance part S3.

Further, the sheet conveyance device has an electostatically attracting unit that electrostatically attracts the sheets onto the conveyance belt 18. The electrostatically attracting unit is composed of a charger 33 acting as a charging unit that charges the sheets on the conveyance belt 18. As shown in FIG. 1, the charger 33 is provided on the downstream side of the image forming part 3 in the sheet conveyance direction. On the other hand, the conveyance belt 18 has an insulation layer and a conductive layer at its front and rear surfaces, respectively (multilayer structure). Further, at least one of the driving roller 14, the driven rollers 15, 16, and 17 bridging the conveyance belt 18, and the tension roller 19 is composed of a roller the front surface of which is formed of metal, and is grounded (not shown). When the sheets are charged by the charger 33, the electostatically attracting unit is structured to attract the sheets onto the conveyance belt 18 by electrical charges accumulated on the front surfaces of the sheets and an electrical attracting force generated by electrical charges on the grounded conveyance belt 18 having polarity opposite to the electrical charges on the front surfaces of the sheets.

As the charger 33, a non-contact type corona charger, particularly, a scorotron type charger with which it is easy to control the potential of the front surfaces of the sheets is desirable. A contact type charger is also applicable. However, if the charger is stained due to contacting with the image forming surfaces of the sheets, the sheets next passing through the charger would also be stained by the charger. Therefore, there would be a likelihood of degrading the image quality of the sheets.

Further, on the downstream side of a sheet carrying region on the conveyance belt 18, i.e., on the downstream side of the third straight conveyance part S3 in the sheet conveyance direction, an electricity remover acting as an electricity removing unit that removes the electrical charges accumulated on the sheets is provided. As the electricity remover 34, a contact type such as an electricity removing brush may be used. However, a non-contact type such as an electricity removing blower is desirable because there is no likelihood of breaking images on the sheets with this.

Further, on the side of the outer periphery of the conveyance belt 18, a first air blowing device 31 and a second air blowing device 32 acting as air blowing units that blow air to the sheets conveyed on the conveyance belt. 18 are provided. The first air blowing device 31 is provided on the downstream side of the first folded conveyance part M1 (or the driven roller 16) in the sheet conveyance direction. The second air blowing device 32 is provided on the downstream side of the second folded conveyance part M2 (or the driven roller 17) in the sheet conveyance direction.

Further, a conveyance belt 39 acting as another conveyance unit is provided along the second conveyance path B. The conveyance belt 39 is also formed of an endless belt having a multiplicity of small holes and bridged by a driving roller 37 and a driven roller 38. Further, a suction duct 40 that suctions air via the small holes formed in the conveyance belt 39 is provided below the conveyance belt 39. The suction duct 40 is also provided with a suction fan (not shown). When the suction fan is driven, air is suctioned via the small holes formed in the conveyance belt 39 so that the sheets can be attracted onto the conveyance belt 39.

Further, as other conveyance units, plural conveyance rollers 52*a* and 52*b* through 61*a* and 61*b* are provided. Among them, the rollers (as indicated by reference symbols 56*a*, 57*a*, 58*a*, 59*a*, 60*a*, 61*a*, and 61*b*) contacting the side of the image forming surfaces of the sheets are rollers having a small contact area with the image forming surfaces. Specifically, these rollers have a plastic or rubber roller member the front surface of which is attached with a multiplicity of abrasive grains such as ceramic. Thus, the rollers can make a point contact with the image forming surfaces. Therefore, breaking of images on the image forming surfaces does not easily occur. Further, the rollers contacting the side of the image forming surfaces of the sheets may be composed of spurring rollers formed of thin-walled metal or the like. Also, in this case, since the rollers make a point contact with the image forming surfaces, the breaking of images on the image forming surfaces does not easily occur. Similarly, both of the pair of the ejecting rollers 26*a* and 26*b* and the roller 27*a* contacting the side of the image forming surfaces of the sheets are also composed of rollers having a small contact area with the image forming surfaces. Therefore, the breaking of images on the image forming surfaces does not easily occur.

Moreover, in the embodiments, a linear speed difference between the rollers on the upstream side and the rollers on the downstream side is eliminated as much as possible in order to prevent the breaking of images on the image forming surfaces of the sheets. Thus, it is possible to prevent the image forming surfaces from coming into contact with a conveyance guide plate due to the deflection of the sheets or prevent the image forming surfaces from scraping against the rollers when the sheets are pulled. An almost constant linear speed between the rollers on the upstream and downstream side is made possible by a one-way clutch in the rollers on the upstream side or by the driving of the rollers on the upstream and downstream sides with the same driving motor.

Next, with reference to FIG. 1, a description is made of the basic operation of the ink jet printer according to the embodiments of the present invention.

As a print starting instruction is issued, a sheet P is fed out from the sheet feeding cassettes 12 or the sheet feeding unit 6. The fed out sheet P collides against the pair of resist rollers 25*a* and 25*b* and temporarily stops. Thus, skewing of the sheet P is corrected. Then, the pair of resist rollers 25*a* and 25*b* start rotating at a predetermined timing, and the sheet P is conveyed to the conveyance belt 18. The sheet P is attracted onto the conveyance belt 18 by air suction of the first suction duct 21. With the rotation of the conveyance belt 18 in this state, the sheet P is conveyed to a position below the image forming head unit 11. At this time, the sheet detecting sensor 35 detects the tip end of the sheet P. In accordance with the detection by the sheet detecting sensor 35, the image forming head unit 11 is driven at a predetermined timing, and ink is ejected onto the sheet P from the nozzles of the respective colors of ink jet heads 10K, 10C, 10M, and 10Y based on the image information of a document scanned by the image scanning part 2. Thus, a full-color image is formed on the sheet P.

Further, it is also possible to form a single-color image by the use of one of the four ink jet heads 10K, 10C, 10M, and 10Y or form a two-color or three-color image by the use of two or three ink jet heads. Further, during the image formation, the speed of the conveyance belt 18 is controlled so as not to fluctuate as much as possible. However, a detecting unit (not shown) actually detects the fluctuation of the speed, whereby ink is ejected at an exact timing corresponding to a sheet position.

In the case of directly ejecting the sheet P on which an image is formed by the image forming part 3 outside the apparatus, the switching claw 28 is directed to a position as indicated by dotted lines in FIG. 1 and then the sheet P is moved straight in a horizontal direction. Subsequently, the sheet P is conveyed to the conveyance belt 39 provided along the second conveyance path B and attracted onto the conveyance belt 39 by the air suction of the suction duct 40. As the conveyance belt 39 rotates in this state, the sheet P is conveyed to the downstream side of the second conveyance path B, decurled by the decurling part 90, and ejected outside the apparatus by the pair of ejecting rollers 26*a* and 26*b*.

Further, in the case of causing the sheet P on which an image is formed to pass through the third conveyance path C and eject the sheet P outside the apparatus, the switching claw 28 is directed to a position as indicated by solid lines in FIG. 1 so that the sheet P can be guided from the first conveyance path A to the third conveyance path C. As the conveyance belt 18 rotates in this state, the sheet P is conveyed to the third conveyance path C while being attracted onto the conveyance belt 18 by the air suction of the first through fourth suction ducts 21 through 24. However, since the driven rollers 16 and 17 exist at the positions of the first folded conveyance part M1 and the second folded conveyance part M2 on the conveyance belt 18, respectively, an air suction force cannot be effected at these positions. Therefore, in this case, the sheet P is charged by the charger 33 so as to generate an electrostatic attracting force between the sheet P and the conveyance belt 18. Thus, an attracting force is also effected at the positions of the first folded conveyance part M1 and the second folded conveyance part M2.

However, the conveyance path (or the conveyance belt 18) is folded at the first folded conveyance part M1. Therefore, even if the electrostatic attracting force is effected as described above, it is difficult for the sheet P to be reliably attracted onto the conveyance belt 18. Depending on the thickness or rigidity of the sheet P or other conditions, there is a likelihood that the front end of the sheet P floats on the downstream side of the first folded conveyance part M1 in the conveyance direction and the image forming surface of the sheet P strongly comes into contact with a peripheral member such as the switching claw 28.

In order to solve this problem, the first air blowing device 31 provided on the downstream side of the first folded conveyance part M1 in the conveyance direction blows air to the sheet P so as to fold the sheet P in a direction along the conveyance belt 18 (or the conveyance path). Thus, the sheet P can be conveyed with its tip end not strongly coming into contact with the switching claw 8 or the like. Then, the sheet P folded by air is attracted onto the conveyance belt 18 by the air suction of the third suction duct 23. Further, in a condition in which the rigidity of the sheet P is particularly great, when the tip end of the sheet P is folded by the first air blowing device 31, the rear end of the sheet P is likely to float on the conveyance belt 18 on the upstream side of the first conveyance part M1 in the conveyance direction. In this case, the second suction duct 22 suctions air so as to prevent the rear end of the sheet P from floating. Note that since the respective suction ducts are capable of separately suction air, the air suction operation of the second suction duct 22 can be controlled without being influenced by the operations of the other suction ducts.

When the sheet P is conveyed to the second folded conveyance part M2, there is a likelihood that the sheet P floats on the conveyance belt 18 like when the sheet P floats at the first folded conveyance part M1 because the conveyance path (or the conveyance belt 18) is folded at this position. Therefore, the second air blowing device 32 blows air to the sheet P so as to fold the sheet P in a direction along the conveyance belt 18 (or the conveyance path). The sheet P thus folded by the air blown from the air blowing device 32 is attracted onto the conveyance belt 18 by the air suction of the fourth suction duct 24.

Then, when the sheet P passes through the electricity remover 34, the electricity accumulated on the sheet P is removed and the electrostatic attracting force is cancelled. Subsequently, the sheet P is separated from the conveyance belt 18 at the driving roller 14 and conveyed to the pair of inverting conveyance rollers 27*a* and 27*b*. Further, the switching claw 29 and the switching claw 30 are directed to positions as indicated by solid lines in FIG. 1, respectively, so as not to prevent the sheet P from passing through. The sheet P reaching the pair of inverting conveyance rollers 27*a* and 27*b* is conveyed to the second conveyance path B by the pair of inverting conveyance rollers 27*a* and 27*b* that normally rotate and the plural conveyance rollers provided on the downstream side of the pair of the conveyance rollers 27*a* and 27*b* in the conveyance direction. Then, the sheet P is decurled by the decurling part 90 and ejected outside the apparatus by the pair of ejecting rollers 26*a* and 26*b*.

As described above, the third conveyance path C functions as an ejecting path that guides the sheet P to the sheet ejecting direction when the pair of inverting conveyance rollers 27*a* and 27*b* normally rotate. Further, in this case, when the sheet P passes through the third conveyance path C, the sheet P is caused to make a detour to the position below the apparatus and be guided to the second conveyance path B. Therefore, the conveyance path before the sheet P is ejected can be longer, thereby making it possible eject the sheet P after sufficiently drying the ink on the sheet P. Thus, stains on the sheet P that could be caused when ink on the ejected sheet P is not sufficiently dried can be prevented.

Further, in the case of performing double-sided printing, the sheet P on which an image is formed by the image forming part 3 is conveyed from the first conveyance path A to the third conveyance path C. Also, in this case, the sheet P is obliquely downwardly conveyed on the conveyance belt 18. The conveyance operation of the conveyance belt 18 is performed like when the sheet P is caused to pass through the third conveyance path C and be ejected outside the apparatus. However, when a detecting sensor 95 detects the rear end of the sheet P, the normal rotation of the pair of inversing conveyance rollers 27*a* and 27*b* is stopped according to the detection signal of the detecting sensor 95. Subsequently, the switching claw 29 provided at the position at which the fourth conveyance path D branches off the third conveyance path C is directed to a position as indicated by dotted lines in FIG. 1 so that the sheet P can be guided to the fourth conveyance path D. When the pair of inverting conveyance rollers 27*a* and 27*b* reversely rotate in this state, the sheet P is reversely fed and guided to the fourth conveyance path D. Thus, the sheet P is conveyed to the fourth conveyance path D with its front and rear sides inverted. In this case, the third conveyance path C functions as an inverting path through which the sheet P is conveyed with its front and rear sides inverted.

Then, the sheet P is guided to the first conveyance path A via the fourth conveyance path D and conveyed to the image forming part 3 again with its front and rear surfaces inverted. As described above, the fourth conveyance path D functions as a double-sided conveyance path through which the sheet P reversely fed from the third conveyance path C is guided to the first conveyance path A for double-sided printing. After this, an image is formed on the rear surface of the sheet P by the image forming part 3 like when the image is formed on the front surface of the sheet P.

The sheet P the both surfaces of which have the images is conveyed from the first conveyance path A to the second conveyance path B in the horizontal direction. At this time, the switching claw 28 provided between the first conveyance path A and the second conveyance path B is directed to a position as indicated by the dotted lines in FIG. 1. Further, when the sheet P is conveyed from the first conveyance path A to the second conveyance path B, blowing of air by the first air blowing device 31 and charging of the sheet P by the charger 33 are not performed. Then, the sheet P is conveyed to the downstream side of the second conveyance path B through the conveyance belt 39 provided along the second conveyance path B in the same manner as described above, decurled by the decurling part 90, and ejected outside the apparatus by the pair of ejecting rollers 26*a* and 26*b*.

Further, in the case of performing single-sided printing and collating the sheets P, the sheet P on which an image is formed by the image forming part 3 is conveyed from the first conveyance path A to the third conveyance path C. Here, the conveyance operation of the conveyance belt 18 is performed like when the sheet P is caused to pass through the third conveyance path C and be ejected. In this case, when the rear end of the sheet P reaches the detecting sensor 95, the normal rotation of the pair of inverting conveyance rollers 27*a* and 27*b* is stopped. Then, the switching claw 30 provided at the branching position at which the fifth conveyance path E branches off the third conveyance path C is directed to the position as indicated by the dotted lines in FIG. 1 so that the sheet P can be guided to the fifth conveyance path E. When the pair of inverting conveyance rollers 27*a* and 27*b* reversely rotate in this state, the sheet P is reversely fed and conveyed to the fifth conveyance path E. Then, the sheet P is fed to the second conveyance path B via the fifth conveyance path E. As described above, the fifth conveyance path E functions as a conveyance path that directly guides the sheet P reversely fed from the third conveyance path C to the second conveyance path B without guiding the sheet P to the image forming part 3.

After that, the sheet P is decurled by the decurling part 90 and ejected outside the apparatus by the pair of ejecting rollers 26*a* and 26*b*. Thus, the sheet P is ejected with both of its front and rear sides and its front and rear surfaces inverted and then accumulated on the sheet ejecting tray 20 in a collated manner. Further, if the third conveyance path C and the fifth conveyance path E are set to have a length sufficient for drying ink on the sheet P before the sheet P is ejected, stains on the sheet P that could be caused when ink on the ejected sheet P is not sufficiently dried can be prevented.

Note that in the embodiments, it is difficult for sheets having a ream weight of 210 kg or more, particularly sheets having great rigidity to pass through the first folded conveyance part M1. Therefore, the sheets having a ream weight of 210 kg or more are not subjected to the double-sided printing or inverting processing and ejected outside the apparatus via the horizontally-provided second conveyance path B. Meanwhile, sheets having a ream weight of less than 210 kg can pass through the first conveyance part M1. Therefore, it is possible to apply the double-sided printing or the inverting processing to the sheets through the third conveyance path C and sufficiently dry ink on the sheets.

Further, in the case of ejecting the sheet P with its front and rear sides being not inverted in the third conveyance path C, the normal rotation of the pair of inverting conveyance rollers 27*a* and 27*b* is controlled so as not to temporarily stop. Thus, time required for ejecting the sheet P can be reduced, and productivity can be improved. Further, the linear speed of the pair of inverting conveyance rollers 27*a* and 27*b* at the normal rotation may be set to be faster than the linear speed thereof at the reverse rotation. In this case, it is possible to improve productivity at the double-sided printing or the inverting processing.

Here, discussion is made of a case in which the sheet P is directly ejected via the third conveyance path C and a case in which the sheet P is inverted and ejected.

In the case of inverting the sheet P in the embodiments of the present invention, the switching claw 30 provided at the branching position is the only one required for inverting the front and rear sides of the sheet P in the third conveyance path C and guiding the sheet P to the third conveyance path C again via the fifth conveyance path E after the rear end of the sheet P is detected by the detecting sensor 95 and the sheet P is stopped. In other words, conventional art cases (such as Patent Documents 3 and 4) require at least two switching claws so as to eject a sheet with its front and rear sides inverted after image formation, while the embodiments of the present invention require only one switching claw for ejecting the sheet P with its front and rear sides inverted. Therefore, compared with the conventional art, the embodiments of the present invention can reduce the number of the switching claws and actuators (driving units) for driving the switching claws.

Figure 8:
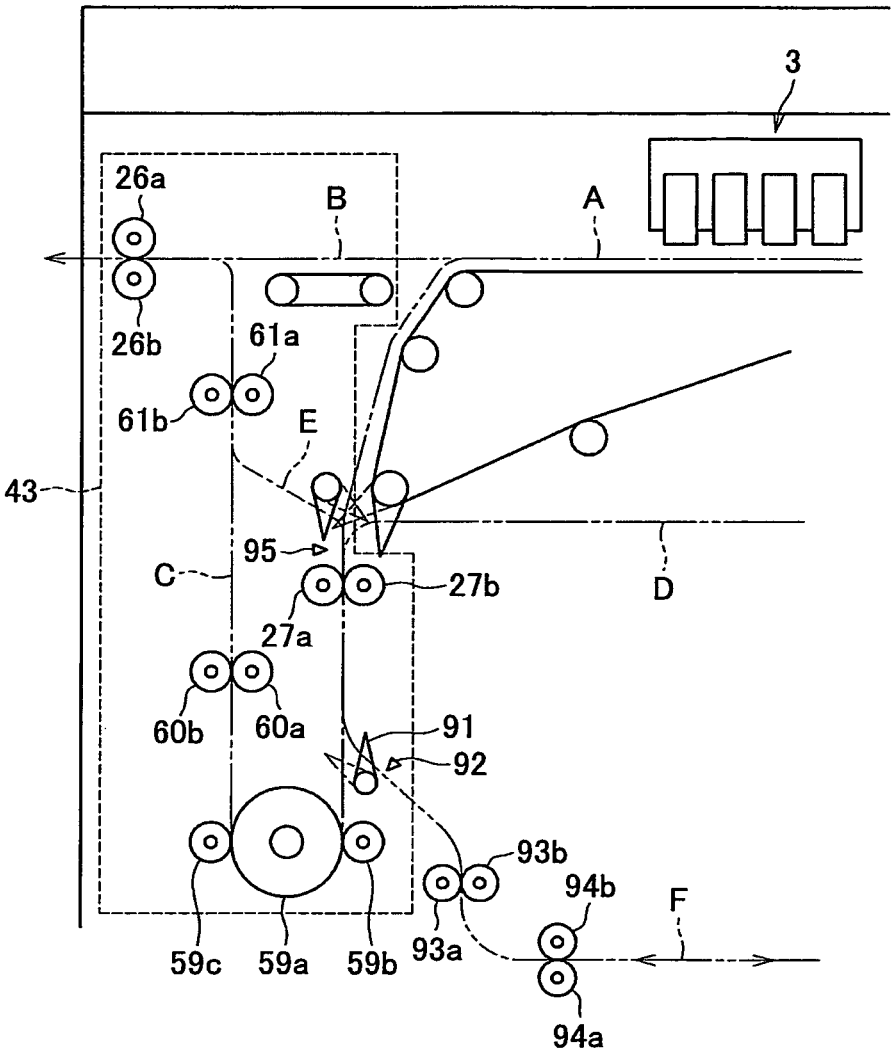
FIG. 8 is a simplified view showing the configuration of an ink jet printer as an example for comparing with the embodiments of the present invention.

FIG. 8 is a simplified view showing the configuration of an ink jet printer as an example for comparing with the embodiments of the present invention.

As shown in FIG. 8, the ink jet printer of the comparative example has the first through fifth conveyance paths A through E formed in the same manner as the embodiments of the present invention. However, different from the ink jet printer of the embodiments of the present invention, the ink jet printer of the comparative example has an inverting path F through which the front and rear sides of a sheet are inverted, and the inverting path F is provided so as to branch off the third conveyance path C. Specifically, the inverting path F branches off on the downstream side of the third conveyance path C in a conveyance direction when the pair of inverting conveyance rollers 27*a* and 27*b* provided along the third conveyance path C normally rotate, and is provided so as to extend in a horizontal direction at a position below the apparatus main body 1. At a position at which the inverting path F branches off the third conveyance path C, a switching claw 91 and a sheet detecting sensor 92 are provided. Further, a pair of conveyance rollers 93*a* and 93*b* and a pair of conveyance rollers 94*a* and 94*b* are provided along the inverting path F. Other than these components, the ink jet printer of the comparative example has basically the same configuration as the inkjet printer of the embodiments of the present invention.

In the case of making the front and rear sides of a sheet inverted in the ink jet printer of the comparative example, the sheet conveyed from the upstream side of the third conveyance path C is conveyed to a downstream side by the pair of inverting conveyance rollers 27*a* and 27*b* that normally rotate. At this time, the switching claw 91 is directed to a position as indicated by dotted lines in FIG. 8, and the sheet is guided to the inverting path F by the switching claw 91. Then, when the detecting sensor 95 detects the rear end of the sheet, the normal rotation of the pair of inverting conveyance rollers 27*a* and 27*b* is stopped according to the detection signal of the detecting sensor 95. After that, the pair of inverting conveyance rollers 27*a* and 27*b* are reversely rotated to make the front and rear sides of the sheet inverted. Thus, the sheet is conveyed to the fourth conveyance path D or the fifth conveyance path E.

Further, the ink jet printer of the comparative example has a drawing unit 43 (a part as indicated by dotted lines in FIG.

8) capable of being drawn to a near side (on the near side of space) relative to the apparatus main body 1. In the drawing unit 43, the second conveyance path B, the third conveyance path C excluding its part on the upstream side, the fifth conveyance path E, and the like are provided. As described above, since the ink jet printer is configured such that some parts of the apparatus are capable of being drawn by the drawing unit 43, a maintenance operation, handling of sheet jamming, and the like are easily performed. However, if the drawing unit 43 is drawn in a state in which a sheet is placed between the third conveyance path C and the inverting path F, there is a likelihood of the sheet being folded or torn by a drawing operation. For this reason, a knob (not shown) having a one-way clutch is provided at the end of the driving shaft of the inverting conveyance roller 27*b*. With the rotation of the knob, the pair of inverting conveyance rollers 27*a* and 27*b* are reversely rotated and the sheet can be extracted from the inverting path F. If the drawing unit 43 is drawn in a state in which the sheet is completely extracted from the inverting path F, tearing of the sheet or the like can be prevented.

Moreover, in order to prevent the drawing unit 43 from being drawn if the operation of rotating the knob is forgotten, a locking mechanism (not shown) that locks the drawing unit 43 is provided. The locking mechanism does not release locking of the drawing unit 43 when the sheet detecting sensor 92 provided at the branching position at which the inverting path F branches off the third conveyance path C detects the sheet. Thus, if the sheet is placed between the third conveyance path C and the inverting path F, the drawing unit 43 cannot be drawn. Therefore, forgetting the operation of rotating the knob is prevented.

However, the ink jet printer, of the comparative example has the following disadvantages.

(1) Since the sheet detecting sensor 92, the locking mechanism, and the like must be provided so as to prevent the folding, tearing, or the like of a sheet caused when the sheet is extracted, the ink jet printer becomes complicated in structure and the number of components in the ink jet printer is increased. As a result, the manufacturing cost of the ink jet printer becomes high.

(2) Since the pair of conveyance rollers 93*a* and 93*b*, the pair of conveyance rollers 94*a* and 94*b*, a guide plate (not shown), and the like must be separately provided so as to ensure conveyance performance on the inverting path F, the number of components in the ink jet printer is increased. As a result, the manufacturing cost of the ink jet printer becomes high.

(3) Since the inverting path F branches off the third conveyance path C and extends in the horizontal direction, the inverting path F occupies large space. As a result, this runs contrary to the downsizing of the apparatus.

In the configuration of the comparative example, if the drawing unit 43 capable of being drawn includes the inverting path F, tearing of a sheet caused when the drawing unit 43 is drawn can be prevented. However, on the other hand, since the area of the drawing unit 43 as seen from the front side thereof becomes large, the freedom of degree in the design of the front side of the apparatus is lost. Further, in this case, when the drawing unit 43 is drawn, the center of gravity of the apparatus is shifted forward and there is a likelihood that the installation condition of the apparatus becomes unstable.

Figure 2:
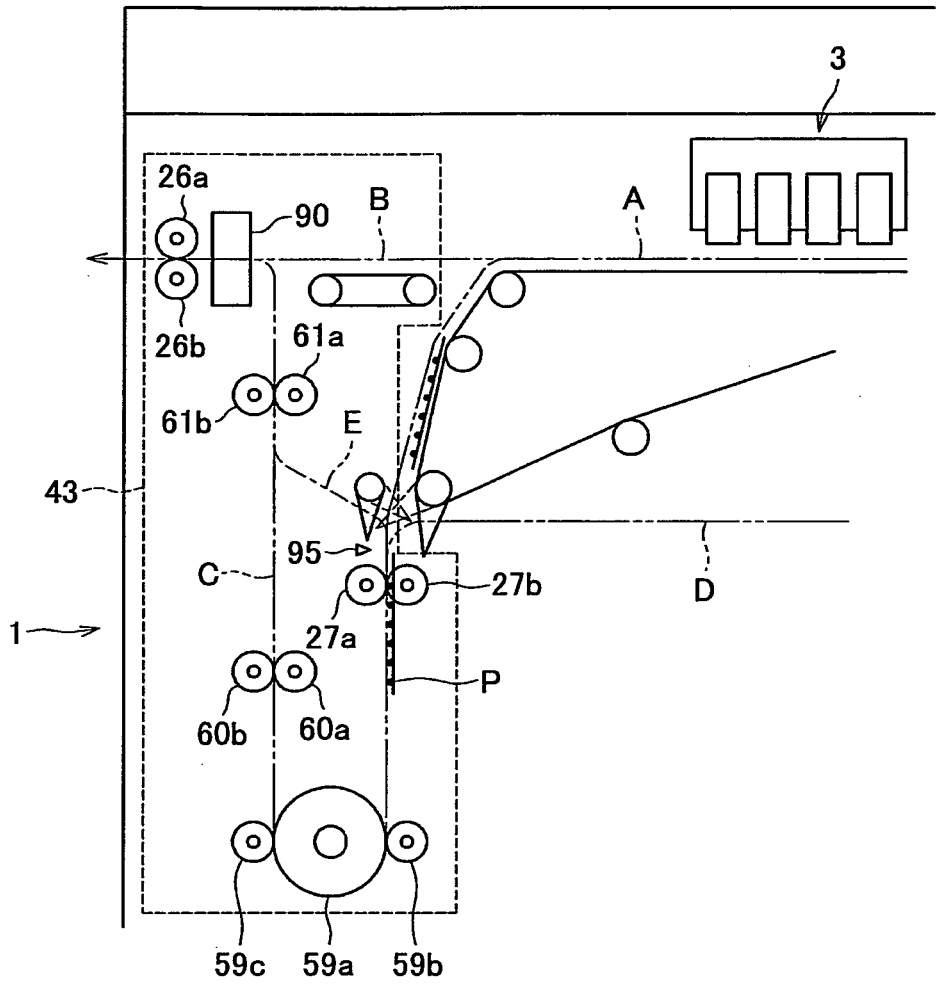
FIG. 2 is a simplified view showing the configuration of the characteristic part of an ink jet printer according to a first embodiment of the present invention.

Meanwhile, FIG. 2 is a simplified view showing the characteristic part of the ink jet printer according to a first embodiment of the present invention. Next, comparing with the above comparative example, a description is made of the characteristic part of this embodiment of the present invention.

As shown in FIG. 2, the ink jet printer according to this embodiment of the present invention has the drawing unit 43 (a part as indicated by dotted lines in FIG. 2) capable of being drawn to a near side (on the near side of space) relative to the apparatus main body 1. In the drawing unit 43, the second conveyance path B, the third conveyance path C excluding some parts on the upstream side of the third conveyance path C, the fifth conveyance path E, and the like are provided.

The third conveyance path C is provided in the drawing unit 43 from its part near the upstream side of the detecting sensor 95 that detects the rear end of the sheet P to its part on the downstream side of the conveyance path C. Thus, as shown in FIG. 2, if the sheet P is stopped with its rear end held by the pair of inverting conveyance rollers 27*a* and 27*b* in the ink jet printer according to this embodiment of the present invention, the sheet P exists in the drawing unit 43. In other words, the third conveyance path C has a sheet stopping region at which the sheet P is temporarily stopped by the pair of inverting conveyance rollers 27*a* and 27*b* before the front and rear sides of the sheet P are inverted, and the entirety of the sheet stopping region is provided in the drawing unit 43.

As described above, in this embodiment of the present invention, if the sheet P is stopped with its rear end held by the pair of inverting conveyance rollers 27*a* and 27*b*, the sheet exists in the drawing unit 43. Therefore, different from the comparative example, there is no likelihood of causing the folding, tearing, or the like of the sheet P when the drawing unit 43 is drawn. Thus, the ink jet printer of this embodiment does not require the sheet detecting sensor 92, the locking mechanism, and the like that prevent the tearing of the sheet P when the drawing unit 43 is drawn. Therefore, the ink jet printer becomes simplified in structure and can prevent an increase in the number of components. As a result, the manufacturing cost of the ink jet printer is reduced.

Further, in this embodiment, the third conveyance path C functions not only as an ejecting path through which the sheet P having an image formed by the image forming part 3 is ejected outside the apparatus, but also as an inverting path through which the sheet P having the image is conveyed with its front and rear sides inverted in a direction opposite to the ejecting direction. Thus, the ink jet printer of this embodiment does not require a separate inverting path. Therefore, the occupied space of the conveyance path can be made small, and downsizing of the apparatus is attained. Further, the ink jet printer of this embodiment does not require conveyance rollers, a guide plate, and the like exclusively used for the conveyance path. Therefore, the number of components is reduced, and the manufacturing cost of the ink jet printer is reduced.

Further, if the third conveyance path C is provided in a vertically extending U-shape as in this embodiment, the occupied space of the third conveyance path C can be made smaller. Thus, the area of the drawing unit 43 as seen from its front side is made small, and the degree of freedom in the design of the front side of the apparatus is improved. Further, since the downsizing of the drawing unit 43 is attained, it is possible to prevent an unstable condition of the apparatus due to the shifting of the center of gravity when the drawing unit 43 is drawn.

As described above, with the configuration of the ink jet printer according to this embodiment of the present invention, the above disadvantages of the comparative example can be eliminated.

Figure 3:
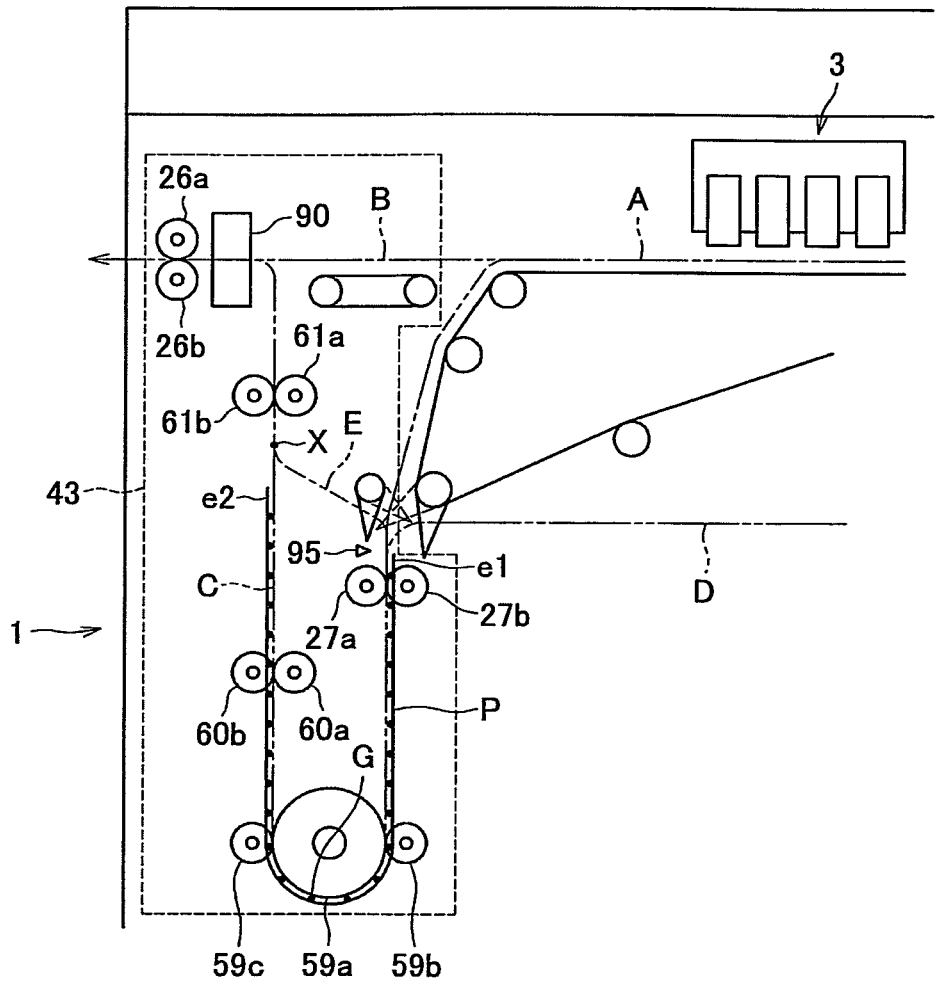
FIG. 3 is a view showing a state in which a sheet having a maximum length in a conveyance direction is conveyed with its front and rear sides inverted in a conveyance path.

Further, FIG. 3 is a view showing a state in which the sheet P having a maximum length in the conveyance direction is conveyed with its front and rear sides inverted in the third conveyance path according to this embodiment of the present invention. As shown in FIG. 3, a joining position X at which the fifth conveyance path E joins the third conveyance path C is provided on the downstream side of the rear end e2 of the sheet P in the conveyance direction (the conveyance direction at the normal rotation) when the front and rear sides of the sheet P are inverted while the sheet is held and stopped by the pair of inverting conveyance rollers 27*a* and 27*b*.

Figure 4:
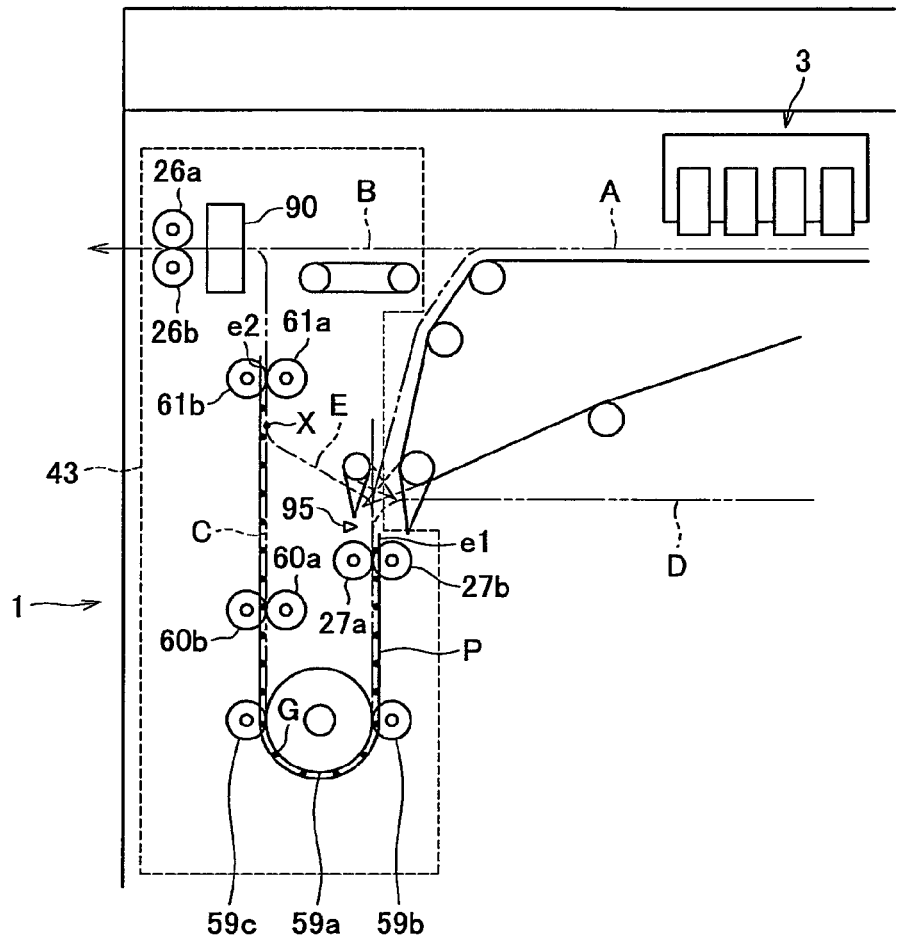
FIG. 4 is a view showing a modified embodiment in which the conveyance path is shortened in a vertical direction.

Conversely, FIG. 4 is a view showing a modified embodiment of the present invention in which the third conveyance path C is shortened in a vertical direction.

As shown in FIG. 4, in this modified embodiment, since the third conveyance path C is shortened, the rear end e2 of the sheet P having the maximum length in the conveyance direction is placed on the downstream side of the joining position X in the ejecting direction (the conveyance direction at the normal rotation). Further, the rear end e2 of the sheet P is held by the pair of conveyance rollers 61*a* and 61*b*. In this case, in order to make the front and rear sides of the sheet P inverted in the third conveyance path C and then eject the sheet P via the fifth conveyance path E, the conveyance rollers 59*a*, 59*b*, 59*c*, 60*a*, 60*b*, 61*a*, and 61*b* are first reversely rotated together with the pair of inverting conveyance rollers 27*a* and 27*b* and the like. Then, before the front end e1 of the sheet P reaches the pair of conveyance rollers 61*a* and 61*b* on the downstream side of the joining position X in the conveyance direction (the conveyance direction at the normal rotation), the pair of conveyance rollers 61*a* and 61*b* are caused to switch their rotation mode from reverse rotation to normal rotation. Next, the sheet P is conveyed in the ejecting direction by the pair of conveyance rollers 61*a* and 61*b* that normally rotate. As described above, if the third conveyance path C is shortened in the vertical direction, the rotation mode of the pair of conveyance rollers 61*a* and 61*b* provided on the downstream side of the joining position X in the ejecting direction must be changed from the reverse rotation to the normal rotation.

Conversely, in the case of the configuration shown in FIG. 3, the rear end e2 of the sheet P is not held by the pair of conveyance rollers 61*a* and 61*b* provided on the downstream side of the joining position X in the conveyance direction when the sheet P is temporarily stopped. Therefore, the configuration shown in FIG. 3 does not have to switch the rotating direction of the pair of conveyance rollers 61*a* and 61*b* so as to eject the sheet P and makes it possible to convey the sheet P more smoothly compared with the configuration shown in FIG. 4. Further, in this case, there is no likelihood that the front end e1 of the sheet P contacts the rear end e2 at the joining position X. Therefore, problems such as breaking of images and stains on the sheet P caused when the front and rear ends e1 and e2 of the sheet P contact each other can be prevented. Note that even in the configuration shown in FIG. 4, if the conveyance path C has a length such that the rear end e2 of the sheet P passes through the joining position X before the front end e1 of the sheet P reaches the joining position X, it is possible to prevent the front end e1 and the rear end e2 from contacting each other at the joining position X. Further, in the description with reference to FIG. 3 or FIG. 4, all of the conveyance rollers 59*a*, 59*b*, 59*c*, 60*a*, and 60*b* provided on the upstream side of the joining position X are driven. However, it goes without saying that only minimum ones of these conveyance rollers may be rotated in accordance with the length of the sheet P.

Further, in the embodiments, the third conveyance path C has a folded conveyance part at its lower part. When a sheet P passes through the folded conveyance part, the image forming surface G of the sheet P is conveyed facing the side of the inner periphery of the folded conveyance part (see FIG. 3 or FIG. 4). Thus, problems such as breaking of images caused when the image forming surface G scrapes against a guide plate or the like provided on the side of the outer periphery of the folded conveyance part can be prevented. FIGS. 3 and 4 show a case in which the sheet P having the maximum length in the conveyance direction is conveyed. However, if the sheet P having a short length shown in FIG. 2 is used, problems such as breaking of images can also be prevented.

Figure 5:
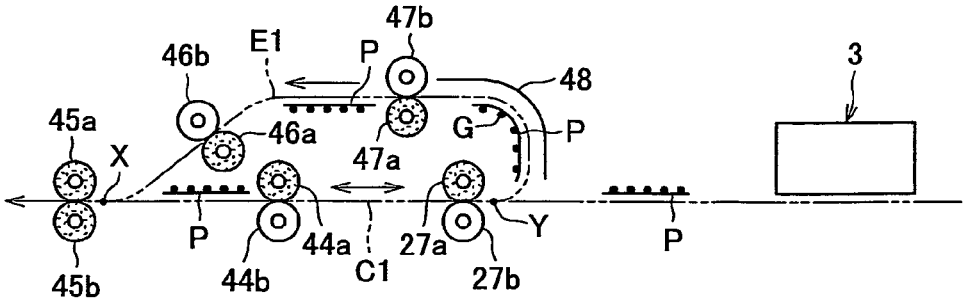
FIG. 5 is a simplified view showing the configuration of the characteristic part of an ink jet printer according to a second embodiment of the present invention.

FIG. 5 is a simplified view showing the configuration of the characteristic part of an ink jet printer according to a second embodiment of the present invention.

As shown in FIG. 5, the ink jet printer according to this embodiment has a conveyance path C1 extending in a horizontal direction and a conveyance path E1 that branches off the conveyance path C1 at a branching position Y on the upstream side of the conveyance path C1 in a sheet conveyance direction and joins the conveyance path C1 at a joining position X on the downstream side of the conveyance path C1. Further, in FIG. 5, reference symbols 44*a* and 44*b* through 47*a* and 47*b* denote conveyance rollers, and reference symbol 48 denotes a guide plate.

Along the conveyance path C1, the pair of inverting conveyance rollers 27*a* and 27*b* capable of normally and reversely rotating are provided. When the pair of inverting conveyance rollers 27*a* and 27*b* normally rotate, the sheet P is ejected outside the apparatus on the left side of FIG. 5 via the conveyance path C1. On the other hand, when the pair of inverting conveyance rollers 27*a* and 27*b* reversely rotate, the sheet P is conveyed with its front and rear sides inverted in the conveyance path C1. In other words, like the above third conveyance path C, the conveyance path C1 functions not only as an ejecting path through which the sheet P is ejected outside the apparatus but also as an inverting path through which the front and rear sides the sheet P are inverted. Hereinafter, a conveyance path similar to the conveyance path C1 is referred to as an ejecting/inverting path.

The sheet P the front and rear sides of which are inverted in the ejecting/inverting path C1 is guided to the conveyance path E1 at the branching position Y and then returned to the ejecting/inverting path C1 at the joining position X. In other words, like the above fifth conveyance path E, the conveyance path E1 is a conveyance path through which the sheet P with its front and rear sides inverted in the ejecting/inverting path C1 is ejected outside the apparatus without passing through the image forming part 3. Hereinafter, a conveyance path similar to the conveyance path E1 is referred to as an inverted-sheet directly ejecting path. Note that at the branching position Y, a switching claw (not shown) that guides the sheet P to the inverted-sheet directly ejecting path E1 is provided.

Further, in this embodiment, the inverted-sheet directly ejecting path E1 has a folded conveyance part provided with the guide plate 48. When the sheet P passes through the folded conveyance part, the image forming surface G of the sheet P is conveyed facing the side of the inner periphery of the folded conveyance part. Thus, like the first embodiment, it is possible to prevent problems such as breaking of images caused when the image forming surface G scrapes against the guide plate 48 provided on the side of the outer periphery of the folded conveyance part. Further, like the above embodiments, among the pair of inverting conveyance rollers 27*a* and 27*b* and the respective conveyance rollers, the rollers (as indicated by reference symbols 27*a*, 44*a*, 45*a*, 46*a*, and 47*a*) contacting the image forming surface G of the sheet P are rollers having a small contact area with the image forming surface G. Therefore, breaking of images on the image forming surface G caused when the respective rollers contact the image forming surface G does not easily occur.

Figure 6A:
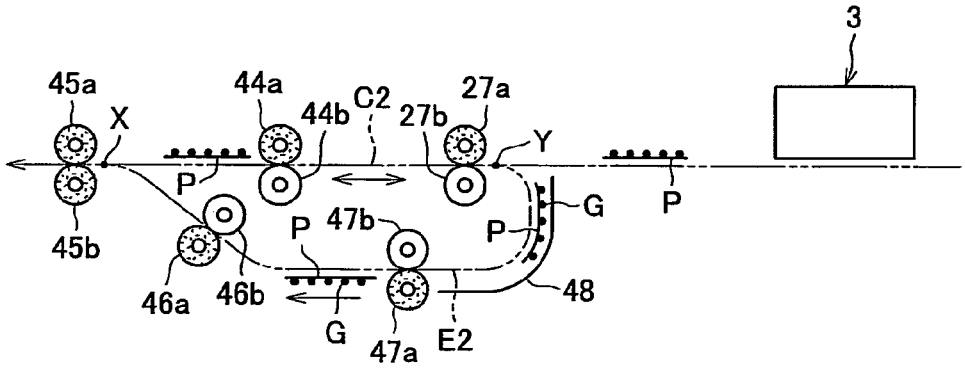
FIGS. 6A and 6B are simplified views showing the configuration of the characteristic part of an ink jet printer according to a third embodiment of the present invention.
Figure 6B:
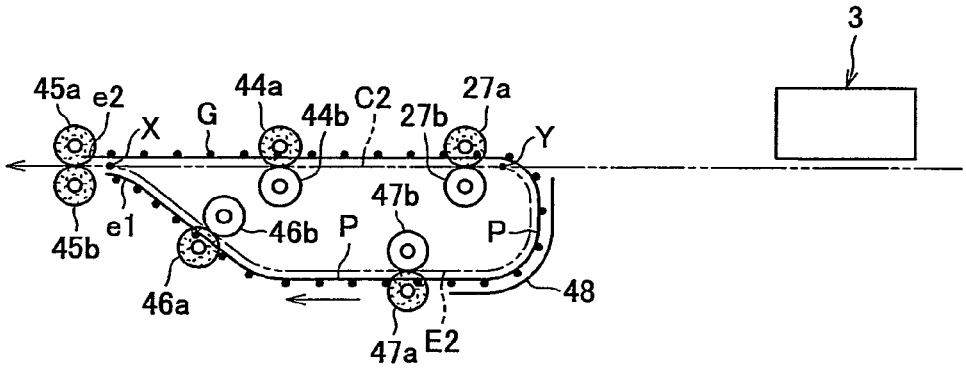

FIGS. 6A and 6B are simplified views showing the configuration of the characteristic part of an ink jet printer according to a third embodiment of the present invention.

Also, in this embodiment, an ejecting/inverting path C2 that functions not only as an ejecting path but also as an inverting path and an inverted-sheet directly ejecting path E2 through which the sheet P with its front and rear sides inverted is ejected outside the apparatus without passing through the image forming part 3 are provided. However, this embodiment is different from the embodiment shown in FIG. 5 in the direction of the image forming surface G of the sheet P when the sheet P passes through the inverted-sheet directly ejecting path E2. Specifically, in the embodiment shown in FIG. 6, the image forming surface G of the sheet P is conveyed facing a side opposite to the ejecting/inverting path C2. More specifically, the image forming surface G of the sheet P passing through the inverted-sheet directly ejecting path E2 is conveyed facing the side opposite to particularly the sheet stopping region of the ejecting/inverting path C2 that temporarily stops the sheet P before the front and rear sides of the sheet P are inverted. Other than this, this embodiment is configured similar to the embodiment shown in FIG. 5.

With this configuration, even if the front end e1 of the long sheet P contacts the rear end e2 at the joining position X when the sheet P is ejected with its front and rear sides inverted (see FIG. 6B), the image forming surface G at the front end e1 and the image forming surface G at the rear end e2 are directed to mutually opposite directions. Therefore, the image forming surfaces G do not scrape against each other. Thus, problems such as breaking of images and stains on the sheet P caused when the end parts of the sheet P contact each other can be prevented.

As described above, the embodiments shown in FIGS. 5, 6A, and 6B are different in the direction of the image forming surface in the conveyance path, and thus have different advantages. The application of these configurations may be determined according to restrictions on layout and other conditions.

FIGS. 7A through 7D are simplified views showing the configuration of the characteristic part of an ink jet printer according to a fourth embodiment of the present invention.

Also, in this embodiment, an ejecting/inverting path C3 that functions not only as an ejecting path but also as an inverting path and an inverted-sheet directly ejecting path E3 through which the sheet P with its front and rear sides inverted is ejected outside the apparatus without passing through the image forming part 3 are provided. Further, in FIGS. 7A through 7D, reference symbol 68 denotes a conveyance belt that conveys the sheet P below the image forming part 3, and reference symbols 62*a* and 62*b* through 67*a* and 67*b* denote conveyance rollers. Further, like the above embodiments, among the respective conveyance rollers and the pair of inverting conveyance rollers 27*a* and 27*b* provided along the ejecting/inverting path C3, the rollers (as indicated by reference symbols 27*a*, 62*a*, 63*a*, 64*a*, 65*a*, 66*a*, and 67*a*) contacting the image forming surface G of the sheet P are rollers having a small contact area with the image forming surface G. Therefore, breaking of images on the image forming surface G caused when the respective rollers contact the image forming surface G does not easily occur. Further, different from the above embodiments, this embodiment is configured such that the inverting conveyance rollers 27*a* and 27*b* are capable of contacting and separating from each other (see FIG. 7B). Specifically, in FIGS. 7A through 7D, the inverting conveyance roller 27*b* on a lower side is a driving roller and the inverting conveyance roller 27*a* on an upper side is a driven roller. The roller 27*a* on a driven side contacts and separates from the roller 27*b* in a driving side.

Next, with reference to FIGS. 7A through 7D, a description is made of the operation of conveying the sheet P in this embodiment.

Figure 7A:
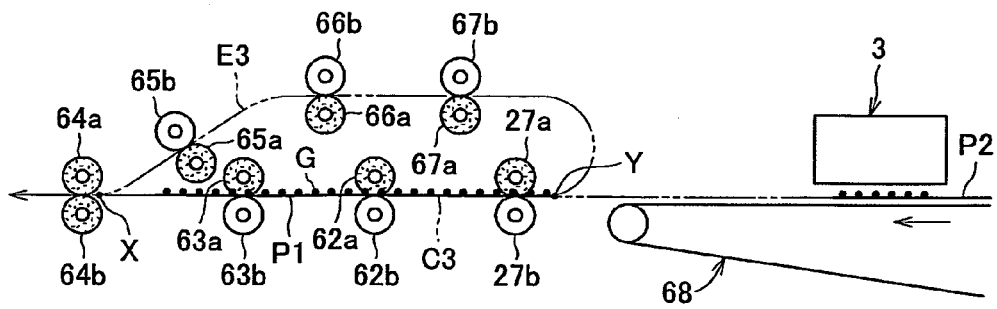
FIGS. 7A through 7D are simplified views showing the configuration of the characteristic part of an ink jet printer according to a fourth embodiment of the present invention.

FIG. 7A shows a state in which the long sheet P1 conveyed to the ejecting/inverting path C3 is held and stopped by the pair of inverting conveyance rollers 27*a* and 27*b*. Further, on the conveyance belt 68, a next sheet P2 is carried. In this state, the pair of inverting conveyance rollers 27*a* and 27*b* are reversely rotated to convey the sheet P1 to the inverted-sheet directly ejecting path E3.

Figure 7B:
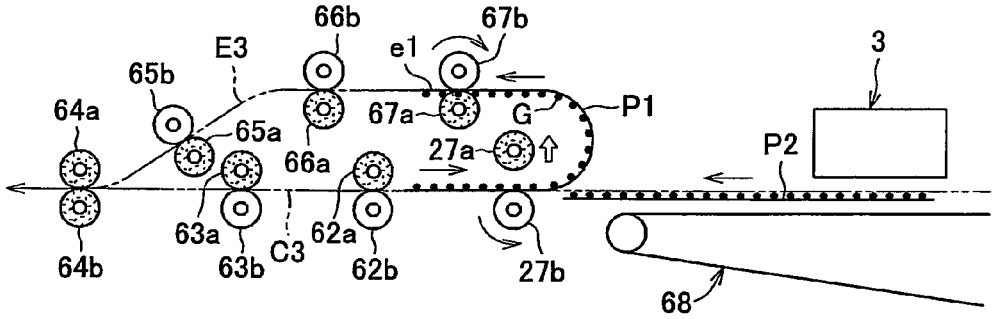

Then, as shown in FIG. 7B, at a timing at which the front end e1 of the sheet P1 in a conveyance direction is held by the pair of conveyance rollers 67*a* and 67*b* on the most upstream side of the inverted-sheet directly ejecting path E3, the inverting conveyance roller 27*a* on the driven side is moved to separate the inverting conveyance rollers 27*a* and 27*b* from each other. Further, at a timing at which the inverting conveyance rollers 27*a* and 27*b* separate from each other, the rotating direction of the inverting conveyance roller 27*b* on the driving side is switched such that the inverting conveyance roller 27*b* normally rotates. In this state, the inverting conveyance roller 27*b* rotates in a direction opposite to the conveyance direction of the pair of conveyance rollers that conveys the sheet P1. However, since the inverting conveyance rollers 27*a* and 27*b* are separated from each other, the conveyance force of the inverting conveyance roller 27*b* is hardly effected. Thus, the sheet P1 is conveyed being free from the rotation of the inverting conveyance roller 27*b*.

Figure 7C:
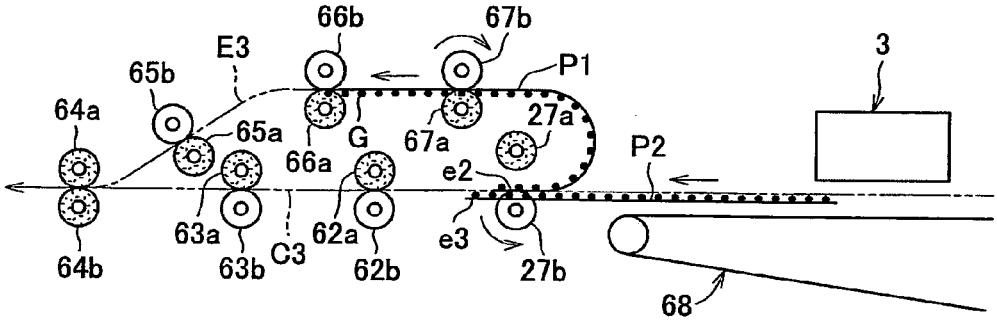

Next, as shown in FIG. 7C, before the rear end e2 of the sheet P1 with its front and rear sides inverted passes through a position between the inverting conveyance rollers 27*a* and 27*b* separated from each other, the front end e3 of the next sheet P2 is conveyed to the position between the inverting conveyance rollers 27*a* and 27*b*. Thus, the rear end e2 of the sheet P1 with its front and rear sides inverted and the front end e3 of the next sheet P2 pass each other between the inverting conveyance rollers 27*a* and 27*b* when they are conveyed.

Figure 7D:
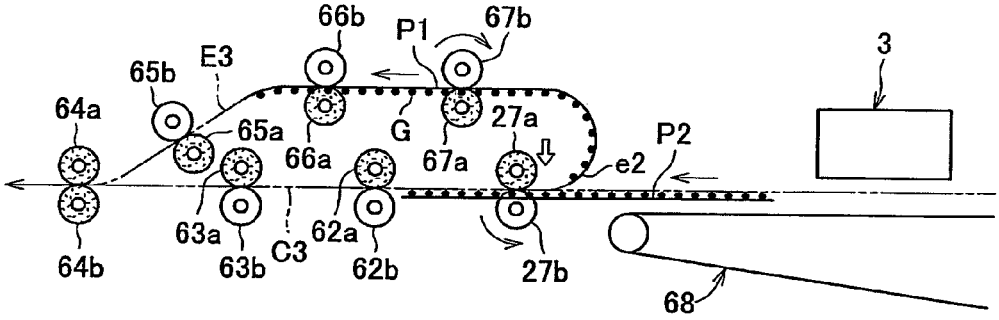

Then, as shown in FIG. 7D, after the rear end e2 of the sheet P1 with its front and rear sides inverted passes through the position between the inverting conveyance rollers 27*a* and 27*b*, the inverting conveyance roller 27*a* on the driven side is moved close to the inverting conveyance roller 27*b* on the driving side. Thus, the next sheet P2 is held by the pair of inverting conveyance rollers 27*a* and 27*b* and conveyed to the downstream side, and then the conveyance of the sheet P2 is temporarily stopped at a predetermined timing. Further, the sheet P1 with its front and rear sides inverted is conveyed to the ejecting/inverting path C3 at the joining position X and then ejected outside the apparatus. After that, the above operations are repeatedly performed.

As described above, since the fourth embodiment of the present invention is configured such that the inverting conveyance rollers 27*a* and 27*b* are capable of contacting and separating from each other, it is possible to make the sheets P1 and P2 pass each other between the inverting conveyance rollers 27*a* and 27*b*. As a result, an interval between the sheet P1 and the sheet P2 can made smaller when they are conveyed, and productivity can be improved.

Further, in FIGS. 7A through 7D, if this embodiment is configured such that the pair of conveyance rollers 27*a* and 27*b* and at least the pair of conveyance rollers (the conveyance rollers 62*a* and 62*b* in FIGS. 7A through 7D) on the downstream side next to the pair of conveyance rollers 27*a* and 27*b* in the ejecting direction are capable of contacting and separating the corresponding paired conveyance rollers from each other, the interval between the sheet P1 and P2 can be made further smaller when they are conveyed. As a result, productivity can be further improved. Further, in this case, it is possible to convey the sheets P1 and P2 with the interval being smaller even if they are long. Therefore, productivity can be improved.

Although the embodiments of the present invention are described above, the present invention is not limited to the above embodiments. Of course, various modifications may be added to the present invention so long as they do not depart from the scope of the present invention. Further, the sheet conveyance device according to the embodiments of the present invention may be installed, besides the ink jet printer shown in FIG. 1, in an image forming apparatus such as a printer having an electrophotographic image forming part, a copier, a facsimile machine, and a multifunction peripheral having plural such functions.

As described above, the ejecting/inverting path is provided in the embodiments of the present invention. Therefore, a single conveyance path can function not only as the ejecting path through which the sheet member is ejected but also as the inverting path through which the front and rear sides of the sheet member are inverted. Thus, since a separate inverting path is not required, the number of components is reduced. As a result, downsizing and cost reduction of the apparatus can be attained, and the degree of freedom in design such as layout is increased.

Further, the inverted-sheet directly ejecting path is provided in the embodiments of the present invention. Therefore, the sheet member with its front and rear sides inverted in the ejecting/inverting path can be ejected outside the apparatus without passing through the image forming part. Thus, the length of the conveyance path required for ejecting the sheet is shortened, and productivity can be improved. Further, since the conveyance rollers, the guide plates, and the like provided on the upstream side of the image forming part do not frequently contact the image forming surface of the sheet member, it is unlikely that the conveyance rollers, the guide plates, and the like become stained.

In addition, on the conveyance path through which the sheet member after image formation is ejected with its front and rear sides inverted, only one switching unit-may be provided to switch the conveyance path. As for FIG. 7, the switching unit may be provided only at the branching position Y. Thus, according to the embodiments of the present invention, the number of switching units and driving units that drive the switching units can be reduced and cost reduction is attained. Moreover, the direction of the image forming surface of the sheet member is always the same in the ejecting/inverting path. Therefore, in the case of using a point-contact roller or the like to prevent an image from being degraded and stained, only the roller on the side contacting the image forming surface may be formed of the point-contact roller or the like. As described above, according to the embodiments of the present invention, since it is not necessary to take measures to prevent an image from being degraded or stained for both rollers of the pair of conveyance rollers, cost reduction can be attained.

Further, as shown in FIG. 2, the entirety of the sheet stopping region, at which the sheet member (the sheet P) is temporarily stopped before the front and rear sides of the sheet member are inverted in the ejecting/inverting path (the third conveyance path), is provided in at least the drawing unit 43. Therefore, even if the drawing unit 43 is drawn in a state in which the sheet member is placed in the sheet stopping region, problems such as folding or breaking of the sheet member caused when the drawing unit 43 is drawn can be prevented.

Further, as shown in FIG. 3 or FIG. 5, if the sheet member (the sheet P) is configured to be conveyed with the image forming surface G facing the side of the inner periphery of the folded conveyance part when the sheet member passes through the folded conveyance part of the ejecting/inverting path (the third conveyance path C) or the inverted-sheet directly ejecting path E1, it is possible to prevent problems such as breaking of images.

Conversely, as shown in FIG. 6A, if the sheet member (the sheet P) is configured to be conveyed with the image forming surface G facing the side opposite to the ejecting/inverting path C2 in the inverted-sheet directly ejecting path E2, problems such as breaking of images and stains on the sheet member caused when the image forming surfaces of the sheet member contact each other can be prevented even if the front end e1 of the sheet member conveyed with its front and rear sides inverted contacts the rear end e2 of the sheet member at the joining position X as shown in FIG. 6B.

Further, if the rear end of the sheet member is configured to pass through the joining position X before the front end of the sheet member with its front and rear sides inverted reaches the joining position X, the front end and rear end of the sheet member can be prevented from contacting each other at the joining position X. Therefore, it is possible to prevent problems such as breaking of images and stains on the sheet member caused when the front and rear ends of the sheet member contact each other.

Further, as shown in FIG. 3, the joining position X is set on the downstream side of the rear end e2 of the sheet member with its front and rear sides inverted when the sheet member (the sheet P) having the maximum length in the conveyance direction is stopped so as to make its front and rear sides inverted in the ejecting/inverting path (the third conveyance path C). Therefore, in order to invert the front and rear sides of the sheet member and convey the sheet member, it is not necessary to switch the rotating direction of the pair of conveyance rollers 61*a* and 61*b* provided on the downstream side of the joining position X in the ejecting direction. Thus, it is possible to smoothly convey the sheet member.

Further, as described with reference to FIGS. 7A through 7D, if the pair of inverting conveyance rollers 27*a* and 27*b* is configured to be capable of contacting and separating the inverting conveyance rollers 27*a* and 27*b* from each other, it is possible to make the rear end e2 of the sheet member (the sheet P1) with its front and rear sides inverted and the front end e3 of the sheet member (the sheet P2) next conveyed pass each other. Thus, the interval between the sheet members P1 and P2 can be made smaller when they are conveyed, and productivity can be improved.

The present application is based on Japanese Priority Application No. 2010-040101 filed on Feb. 25, 2010, the entire contents of which are hereby incorporated herein by reference.

What is claimed is:

1. A sheet conveyance device installed in an image forming apparatus having an image forming unit configured to form an image on a sheet member, the sheet conveyance device comprising:

an ejecting/inverting path that functions as an ejecting path configured to eject, without reversing a leading edge and a trailing edge of the sheet member, the sheet member having the image formed thereon by the image forming unit outside the image forming apparatus by conveying the sheet member in an ejecting direction in which the sheet member is ejected, the ejecting/inverting path also functioning as an inverting path configured to reverse the leading edge and the trailing edge of the sheet member by conveying the sheet member in a direction opposite to the ejecting direction; and an inverted-sheet directly ejecting path configured to eject the sheet member, the leading edge and the trailing edge of the sheet member being reversed in the ejecting/inverting path, outside the image forming apparatus without passing the sheet member through the image forming unit by conveying the sheet member in the direction opposite to the ejecting direction.

2. The sheet conveyance device according to claim 1, further comprising:

a drawing unit configured to be detachably attached to an apparatus main body, wherein a sheet stopping region is disposed inside the drawing unit, and wherein the sheet member is temporarily stopped at the sheet stopping region prior to the leading edge and the trailing edge of the sheet member being reversed in the ejecting/inverting path.

3. The sheet conveyance device according to claim 1, wherein at least one of the ejecting/inverting path and the inverted-sheet directly ejecting path includes a folded conveyance part, and when the sheet member passes through the folded conveyance part, an image forming surface of the sheet member faces an inner periphery of the folded conveyance part.

4. The sheet conveyance device according to claim 1, wherein the inverted-sheet directly ejecting path is disposed such that the inverted-sheet directly ejecting path branches off from the ejecting/inverting path at a first position upstream in the ejecting direction of the ejecting/inverting path, while the inverted-sheet directly ejecting path merges with the ejecting/inverting path at a second position downstream in the ejecting direction of the ejecting/inverting path, and when the leading edge and the trailing edge of the sheet member have been reversed in the ejecting/inverting path, the sheet member is guided toward the inverted-sheet directly ejecting path at the first position, and the sheet member is guided from the inverted-sheet directly ejecting path to the ejecting/inverting path at the second position.

5. The sheet conveyance device according to claim 4, wherein, in the inverted-sheet directly ejecting path, the sheet member is conveyed while an image forming surface of the sheet member faces a side opposite to the ejecting/inverting path.

6. The sheet conveyance device according to claim 4, wherein, when the leading edge and the trailing edge of the sheet member have been reversed in the ejecting/inverting path so that the leading edge becomes a second trailing edge of the sheet member and the trailing edge becomes a second leading edge of the sheet member, the second trailing edge of the sheet member passes through the second position prior to the second leading edge of the sheet member reaching the second position.

7. The sheet conveyance device according to claim 4, wherein, when the leading edge and the trailing edge of the sheet member have been reversed so that the leading edge becomes a second trailing edge of the sheet member and the trailing edge becomes a second leading edge of the sheet member, in a state in which the sheet member having a maximum length in a conveyance direction has been stopped in the ejecting/inverting path so as to reverse the leading edge and the trailing edge of the sheet member, the second position is disposed downstream in the ejecting direction of the second trailing edge of the sheet member.

8. The sheet conveyance device according to claim 1, further comprising:

a pair of inverting conveyance rollers disposed in the ejecting/inverting path and configured to be rotated in a normal direction and in a reverse direction, wherein, when the inverting conveyance rollers are rotated in the normal direction, the sheet member is conveyed in the ejecting direction, when the inverting conveyance rollers are rotated in the reverse direction, the sheet member is conveyed while the leading edge and the trailing edge of the sheet member are reversed, the inverting conveyance rollers are configured to contact and separate from each other, and when the inverting conveyance rollers have been separated from each other, the sheet member whose leading edge and trailing edge have been inverted so that the leading edge becomes a second trailing edge of the sheet member and the trailing edge becomes a second leading edge of the sheet member and a subsequent second sheet member are conveyed while the second trailing edge of the sheet member and a leading edge of the second sheet member slidably contact each other between the separated inverting conveyance rollers.

9. The sheet conveyance device according to claim 8, further comprising:

a pair of conveyance rollers disposed downstream of the pair of inverting conveyance rollers in the electing direction in the electing/inverting path, wherein the conveyance rollers are configured to contact and separate from each other, when the inverting conveyance rollers have been separated from each other and the conveyance rollers have been separated from each other, the sheet member whose leading edge and the trailing edge have been inverted so that the leading edge becomes a second trailing edge of the sheet member and the trailing edge becomes a second leading edge of the sheet member and a subsequent second sheet member are conveyed while the second trailing edge of the sheet member and a leading edge of the second sheet member slidably contact each other between the separated inverting conveyance rollers and between the separated conveyance rollers.

10. The sheet conveyance device according to claim 1, wherein, when the sheet member is discharged without the leading edge and the trailing edge of the sheet member being reversed in the ejecting/inverting path, the sheet conveyance device causes the sheet member to be conveyed while the sheet conveyance device avoids stopping the sheet.

11. The sheet conveyance device according to claim 1, wherein a first conveyance speed for discharging the sheet member in a first case where the leading edge and the trailing edge of the sheet member are reversed in the ejecting/inverting path is set to be greater than a second conveyance speed for discharging the sheet member in a second case where the leading edge and the trailing edge of the sheet member are not reversed.

12. The sheet conveyance device according to claim 1, wherein the image forming device includes an inkjet image forming unit configured to form an image by discharging ink onto the sheet member, and the ejecting/inverting path and the inverted-sheet directly ejecting path are set to have a length sufficient for drying the ink on the sheet member before the sheet member is ejected.

13. The sheet conveyance device according to claim 1, wherein conveyance rollers provided in the ejecting/inverting path and the inverted-sheet directly ejecting path are rollers having a small contact area with an image forming surface of the sheet member.

14. The sheet conveyance device according to claim 1, further comprising:

a decurler configured to corrects a curl of the sheet member passing through the ejecting/inverting path or the inverted-sheet directly ejecting path.

15. An image forming apparatus comprising:

an image forming unit configured to form an image on a sheet member; and a sheet conveyance device, wherein the sheet conveyance device includes:

an ejecting/inverting path that functions as an ejecting path configured to eject, without reversing a leading edge and a trailing edge of the sheet member, the sheet member having the image formed thereon by the image forming unit outside the image forming apparatus by conveying the sheet member in an ejecting direction in which the sheet member is ejected, the ejecting/inverting path also functioning as an inverting path configured to reverse the leading edge and the trailing edge of the sheet member by conveying the sheet member in a direction opposite to the ejecting direction, and an inverted-sheet directly ejecting path configured to eject the sheet member, the leading edge and the trailing edge of the sheet member being reversed in the ejecting/inverting path, outside the image forming apparatus without passing the sheet member through the image forming unit by conveying the sheet member in the direction opposite to the ejecting direction.

* * * * *